US005109234A

United States Patent [19]

Otis, Jr. et al.

[11] Patent Number: 5,109,234

[45] Date of Patent: Apr. 28, 1992

[54] PRINTHEAD WARMING METHOD TO DEFEAT WAIT-TIME BANDING

[75] Inventors: David R. Otis, Jr., Somerville, Mass.; May F. Ho, La Mesa, Calif.

[73] Assignee: Hewlett-Packard Company, Palo Alto, Calif.

[21] Appl. No.: 583,297

[22] Filed: Sep. 14, 1990

[51] Int. Cl.[5] ..... B41J 2/365; B41J 2/38

[52] U.S. Cl. ..... 346/1.1; 346/140 R; 346/76 PH

[58] Field of Search ..... 346/1.1, 140, 75, 76 PH

[56] References Cited

U.S. PATENT DOCUMENTS 4,463,359 7/1984 Ayata et al. ..... 346/1.1
4,490,728 12/1984 Vaught et al. ..... 346/1.1
4,712,172 12/1987 Kiyohara et al. ..... 346/1.1
4,791,435 12/1988 Smith et al. ..... 346/140 R

FOREIGN PATENT DOCUMENTS 2169856 7/1986 United Kingdom ..... 346/140 R

*Primary Examiner*—Benjamin R. Fuller
*Assistant Examiner*—Alrick Bobb

[57] ABSTRACT

A thermal technique for reducing print density shifts due to print wait time in thermal ink jet printers. The ink jet firing resistors of the printhead are driven with warming pulses having a pulse width insufficient to cause ink drop firing at the warming pulse frequency. They are driven for an interval that depends on the amount of time that has elapsed since printing by the printhead last occurred, or an interval that depends on the amount of decrease in the printhead temperature since printing stopped. In a particular embodiment of the printhead warming technique, the warming pulses have the same amplitude as the ink drop firing pulses, and a higher frequency.

10 Claims, 3 Drawing Sheets

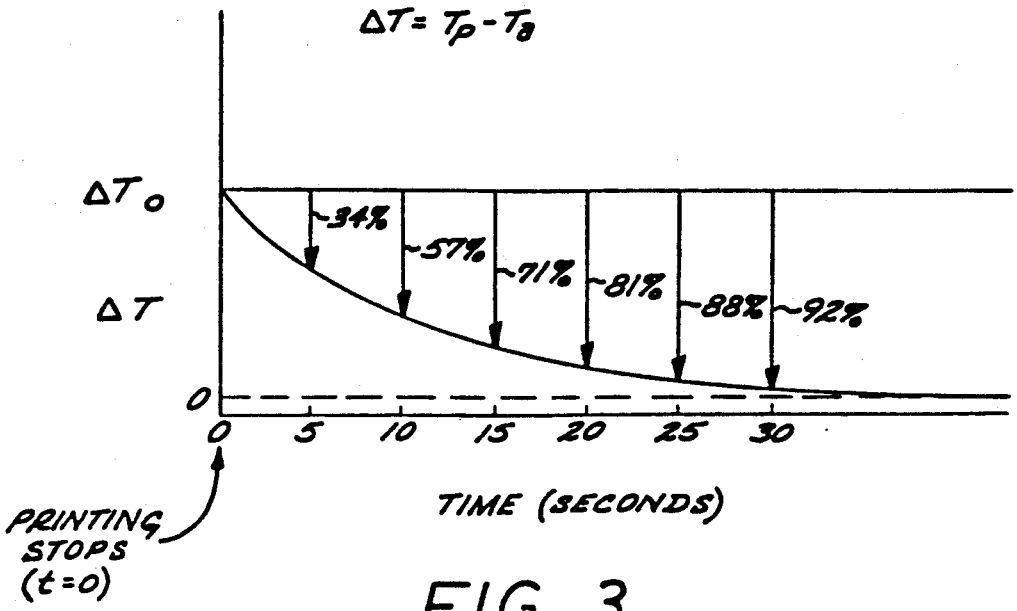
FIG. 3
FIG. 4
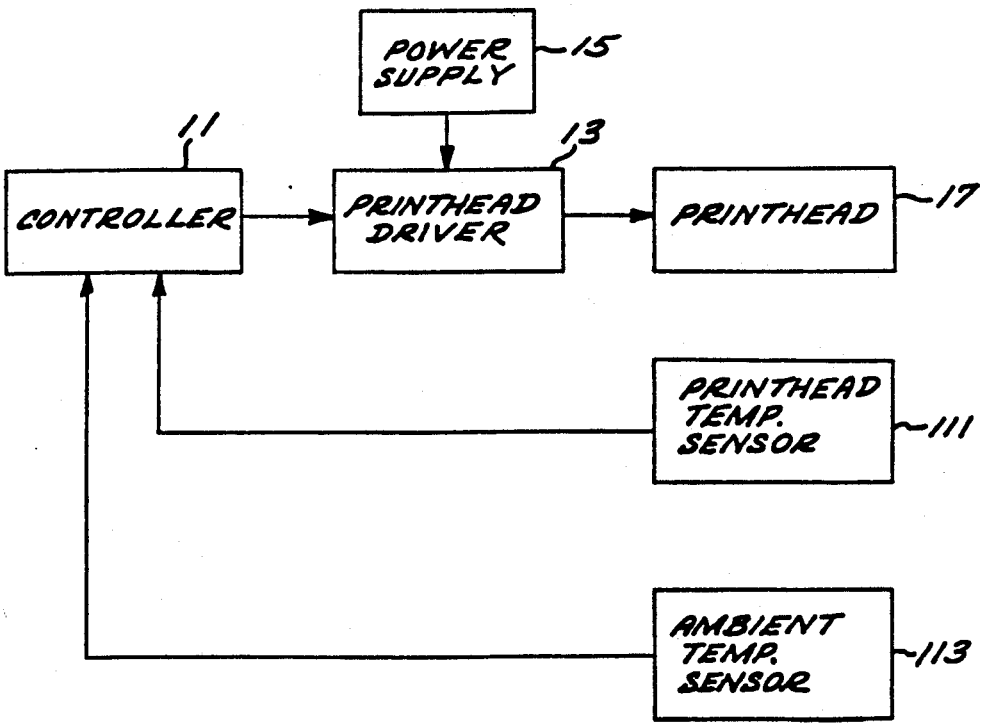

PRINTHEAD WARMING METHOD TO DEFEAT WAIT-TIME BANDING

BACKGROUND OF THE INVENTION

The subject invention relates generally to thermal ink jet printers, and is directed more particularly to a technique for maintaining consistently high print quality in the event of unplanned or unforseen delays in printing a particular document or page.

Thermal ink jet printers utilize thermal ink jet printheads that comprise an array of precision formed nozzles, each of which is in communication with an associated ink containing chamber that receives ink from a reservoir. Each chamber includes an ink drop firing resistor which is located opposite the nozzle so that ink can collect between the ink drop firing resistor and the nozzle. The ink drop firing resistor is selectively heated by voltage pulses to drive ink drops through the associated nozzle opening in the orifice plate. During each pulse, the ink drop firing resistor is rapidly heated, which causes the ink directly adjacent the ink drop firing resistor to vaporize and form a bubble. As the vapor bubble grows, momentum is transferred to the ink between the bubble and the nozzle, which causes such ink to be propelled through the nozzle and onto the print media.

A consideration with the operation of thermal ink jet printheads is the variation in print density that results from the printhead cooling that takes place during delays that occur while printing a particular output. Such variation in print density obtains because the physical properties of the ink (most notably the viscosity) are temperature-dependent. Volume of the ejected drop and spot size on the media depend on the physical properties of the ink, and hence on the ink temperature. Finally, the ink temperature and the printhead temperature are very nearly the same; so the printhead temperature determines the ink temperature, which determines the ink properties, which determine the image density on the media.

If the printing of a particular output such as a graphics image is not accomplished generally continuously, for example, wherein the printer has to repeatedly wait until further data is received, print density shifts occur, which generally look like bands of different print densities across the printed output. The occurrence of such print density shifts is sometimes called "wait time banding."

The problem of wait time banding has been addressed by suggesting that applications software should be faster to reduce wait times. While such approach might alleviate wait time banding to some degree, it requires various parties to address the problem, and moreover would probably not address the development of higher speed thermal ink jet printers with which the wait time banding problem would be more aggravated.

SUMMARY OF THE INVENTION

It would therefore be an advantage to provide a thermal ink jet printer that reduces print density shifts caused by printer wait times that occur when the printer has to wait for more print data.

The foregoing and other advantages are provided by the invention in a thermal ink jet printer that includes a thermal ink jet printhead having a plurality of ink jet firing resistors, and drive circuitry for applying, prior to continuation of printing, printhead warming energy to the ink jet firing resistors at a power level that is insufficient to cause ink drop firing but sufficient to cause a relatively fast increase in printhead temperature. More particularly, if the printhead has been idle for more than a predetermined amount of time, the driver circuitry provides to the ink drop firing resistors pulses having power that is insufficient to cause ink ejection, with the amount of warm-up pulsing dependent on the length of idle time. As a result of the low power warming pulses, the temperature of the printhead is raised to approximately the same level it had while printing.

BRIEF DESCRIPTION OF THE DRAWING

The advantages and features of the disclosed invention will readily be appreciated by persons skilled in the art from the following detailed description when read in conjunction with the drawing wherein:

FIG. 3 is a graph schematically illustrating the cool down characteristic of an illustrative example of a thermal ink jet printhead utilized with the invention. The graph is utilized to determine the amount of warm-up pulsing required as a function of idle time.

FIG. 4 is a schematic block diagram of the thermal ink jet printer components for implementing a further embodiment of the subject invention.

DETAILED DESCRIPTION OF THE DISCLOSURE

Figure 1:
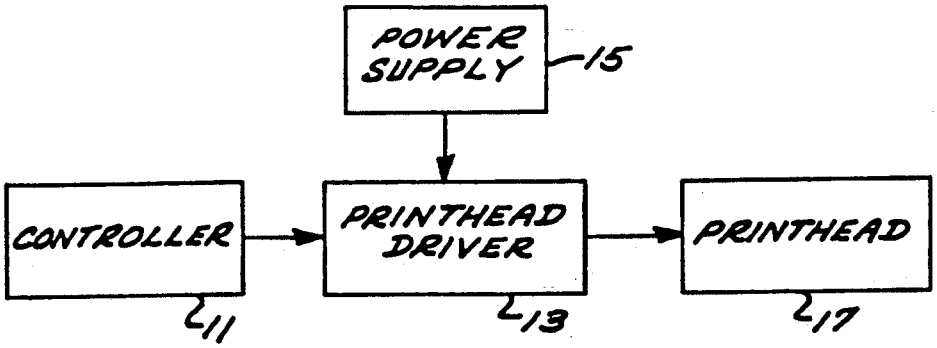
FIG. 1 is a schematic block diagram of the thermal ink jet printer components for implementing the subject invention.

In the following detailed description and in the several figures of the drawing, like elements are identified with like reference numerals.

Referring now to FIG. I, shown therein are components of a thermal ink jet printer that employs the techniques of the invention. A controller 11 receives print data input and processes the print data to provide print control information to printhead driver circuitry 13. The print-head driver circuitry 13 receives power from a power supply 15 and drives the individual ink drop firing resistors of a printhead 17.

More particularly, the controller which can comprise a microprocessor architecture in accordance with known controller structures, provides control pulses representative of the drive pulses to be produced by the printhead driver circuitry 13. By way of illustrative example, the controller provides control pulses having the desired pulse width and pulse frequency, and the printhead driver circuitry produces drive voltage pulses of the same width and frequency, and with an amplitude determined by the power supply 15. Essentially, the controller provides pulse width modulation information, while the amplitude of the voltage pulses is determined by the driver circuitry 13 and the power supply 15.

As with known controller structures, the controller 11 would typically provide other functions such as control of the printhead carriage (not shown) and control of movement of the print media.

In accordance with the invention, the controller 11 causes the printhead ink drop firing resistors to be driven with warm-up voltage pulses prior to proceeding with printing if the printhead has been idle for more than a predetermined amount of time after last printing. The warm-up pulses provide energy that is insufficient to cause ink drop firing, and therefore cause a rapid increase in the printhead temperature since no ink drop firing occurs. Ink drop firing is an important mechanism for printhead cooling, so the resistive heating provided by the pulses is very fast and effective when drop firing is inhibited.

By way of illustrative example, the warm-up voltage pulses have the same amplitude and five times the frequency as the pulses utilized for ink drop firing, but are approximately one-fourth of the width of the threshold or turn-on pulse width necessary for ink drop firing at the ink drop firing pulsing frequency. By controlling the warm-up pulses to be approximately one-fourth the width of the turn-on pulse width ensures that ink drop firing does not occur pursuant to the application of warm-up pulses. Depending upon the characteristics of the printhead, the warm-up pulses can generally be less than one-half the threshold or turn on pulse width at the warm-up pulsing frequency. The warm-up pulsing frequency is selected to be higher than the printing pulsing frequency so that warm-up can take place quickly.

The energy delivered to the printhead is nearly the same for warm up and ink drop firing, but no ink drops are fired during warm-up pulsing since the resistors do not reach a sufficiently high temperature. In particular, the longer pulse width used for ink drop firing heats the resistor sufficiently to cause the ink to boil, while the shorter pulse width for warm-up does not.

While the foregoing has been directed to increasing frequency and reducing pulse width for warm-up pulsing, it should be appreciated that pulse amplitude could also be modified to provide the requisite warm-up energy. Such modification could be made in conjunction with pulsing frequency and/or pulse width changes. The appropriate reduction in pulse amplitude can be derived analyzing the energy of the warm-up pulses provided pursuant to the above example of warm-up pulse widths that are less than the ink firing pulse widths. By way of illustrative example, for a warm-up pulse width that is the same as the ink firing pulse width, the warm-up pulse voltage could be the determined threshold voltage (i.e., the voltage necessary to fire an ink drop) divided by the square root of the factor applied to the pulse width, which in the foregoing example is 4, the square root of which is 2.

The printhead ink drop firing resistors are driven with warm-up pulses to raise the printhead temperature to be close to the temperature it had when the printing was interrupted; the amount of warm-up pulses required prior to proceeding with the printing operation depends on the duration of the intervening wait or idle time. For a particular pulsing frequency, this number of pulses will determine a pulsing period or interval. Determination of the interval during which warm-up pulses are provided can be by look-up table or by equation, for example.

Figure 2:
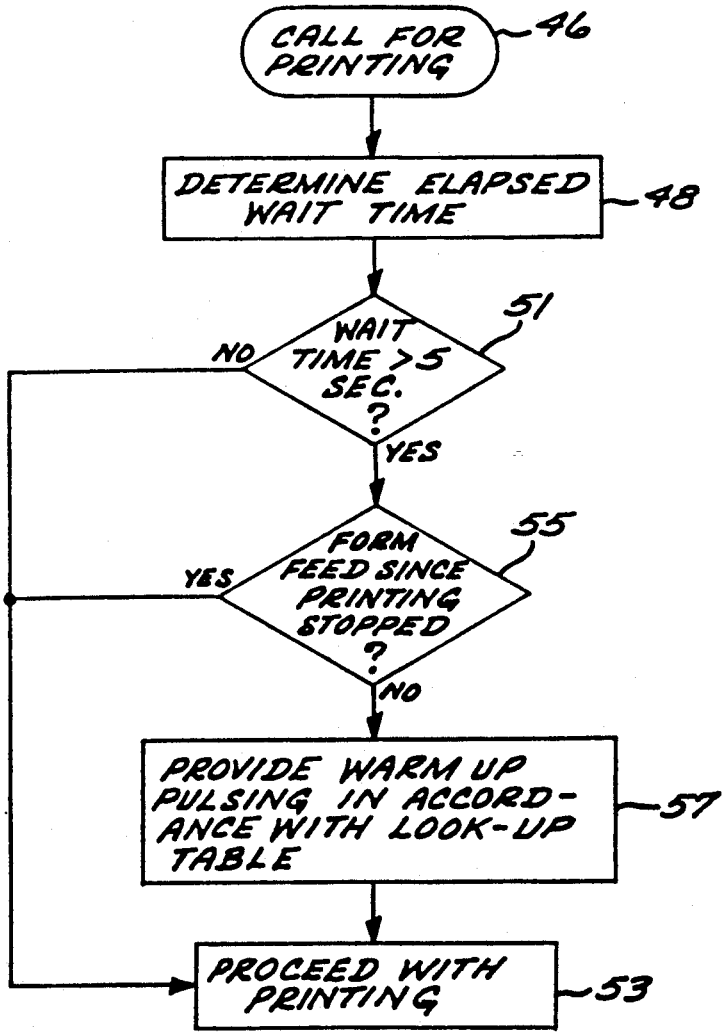
FIG. 2 is a flow diagram that sets forth a procedure for calculating and applying printhead warm-up pulses to a thermal ink jet printhead with the printer of FIG. 1.

Turning now to FIG. 2, set forth therein is a flow diagram of a printhead warming process in accordance with the invention that is employed when printing is to be continued after the printer is in the idle state, for example, while waiting for further print data. At 46 a call for printing occurs, and at 48 the elapsed wait time is determined. A determination is then made at 51 as to whether the printer wait or idle time has exceeded a certain threshold interval, beyond which the image density shift becomes perceptible. By way of illustrative example, this interval can be 5 seconds. If the wait time did not exceed 5 seconds, printing proceeds at 53. If the wait time exceeded the threshold interval, a determination is made at 55 as to whether a form feed has occurred since the last print operation. If yes, printing proceeds at 53.

If the determination at 55 is no, a form feed did not occur since the last print operation, the printhead thermal resistors are driven with warm-up pulses for a time interval that depends on the duration of the wait time being compensated. By way of illustrative example, such warm-up pulsing duration is determined with reference to a look-up table. Alternatively, an equation that determines warm-up pulsing duration as a function of wait time can be utilized. As discussed more fully below, in the absence of a temperature sensor on the printhead, a "most likely" temperature offset (relative to ambient) at the time of interruption is assumed, and the look-up table would be based on that assumption.

After the printhead firing resistors are driven with warm-up pulses pursuant at 57, printing proceeds at 53. Essentially, the warm-up pulsing is provided when the printhead has been idle for more than 5 seconds and printing is resumed on the same page that was being printed when interruption of the printing occurred. Otherwise, printing proceeds without warm-up pulsing, for example when a new page is started after printing was interrupted. While warm-up pulsing can be utilized at the start of printing of a new page, it may be necessary since the change to darker print density on a new page is not as noticeable as a light density band between darker density bands.

The printhead warm-up techniques of the invention can be implemented in conjunction with a low temperature start up procedure as disclosed in commonly assigned U.S. Pat. No. 4,791,435, issued Dec. 13, 1988, which is incorporated herein by reference. In such implementation, a determination would be made to determine whether a low temperature startup is required. If yes, then the low temperature startup is performed prior too proceeding with printing instead of warm-up pulsing as described herein.

Referring now to FIG. 3, set forth therein is a graph of the cool down differential temperature characteristic of an illustrative example of a thermal printhead having a thermal time constant of 12 seconds. The differential temperature $\Delta T$ is the difference between the actual printhead temperature $T_p$ and the ambient temperature $T_a$. At the stop of printing, the differential temperature $\Delta T$ is at $\Delta T_o$, and then decreases exponentially with time to zero.

The temperature rise pursuant to warm-up pulsing is generally linear, and therefore the amount of warm-up pulsing is readily determined from (a) the amount of pulsing time required to raise the printhead temperature by $\Delta T_o$ and (b) the cool down differential temperature characteristic of the printhead. For example as indicated in FIG. 3, the percentage drop of the differential temperature $\Delta T$ can be determined for different wait times. For warm-up pulses having predetermined amplitude, width and frequency characteristics, such differential temperature drop percentages can then be applied to the time required to increase the differential temperature from zero to $\Delta T_o$ to determine the necessary pulsing times for differential temperature drops of less than $\Delta T_o$. Thus, relative to a printhead having the characteristic set forth in FIG. 3, a wait time of 10 seconds would call for a pulsing interval of about 57 percent of the time determined necessary to produce a temperature increase of $\Delta T_o$ in the printhead.

Set forth in the following table are look-up table values for pulse time intervals for different wait time ranges for a Hewlett Packard Model No. 51605A as utilized with warm-up pulses having an amplitude of 10.5 volts, a pulse width of 1.3μ seconds, and a pulse frequency of 15,000 Hz, and assuming a $\Delta T_o$ of 4 degrees C.

| Wait Time (sec) | Pulse Time (msec) |
|---|---|
| $5 > t \geqq 0$ | 0 |
| $10 > t \geqq 5$ | 350 |
| $15 > t \geqq 10$ | 575 |
| $20 > t \geqq 15$ | 725 |
| $25 > t \geqq 20$ | 800 |
| $30 > t \geqq 25$ | 875 |
| $t \geqq 30$ | 925 |

Alternatively to the look-up table, an equation can be used to determine warm-up pulsing intervals as a function of wait time. Such equation would also be derived from the amount of pulsing time required to raise the printhead temperature by $\Delta T_o$ and the cool down differential temperature characteristic of the printhead.

A consideration with the foregoing implementation of the invention is the assumption of a fixed maximum differential temperature $\Delta T_o$, which may not be appropriate for all operating conditions; if real time temperature measurement can be accomplished in the ink jet printer, such as assumption would not be necessary. Only a correlation between the desired temperature increase (i.e., $|\Delta T|$) and energy is necessary to achieve tat temperature increase.

Referring now to FIG. 4, set forth therein is an implementation of the invention which utilizes the actual printhead temperature and is not limited to a fixed maximum differential temperature. The printer of FIG. 4 adds a printhead temperature sensor 11 and an ambient temperature sensor 113 to the printer of FIG. 1.

Figure 5:
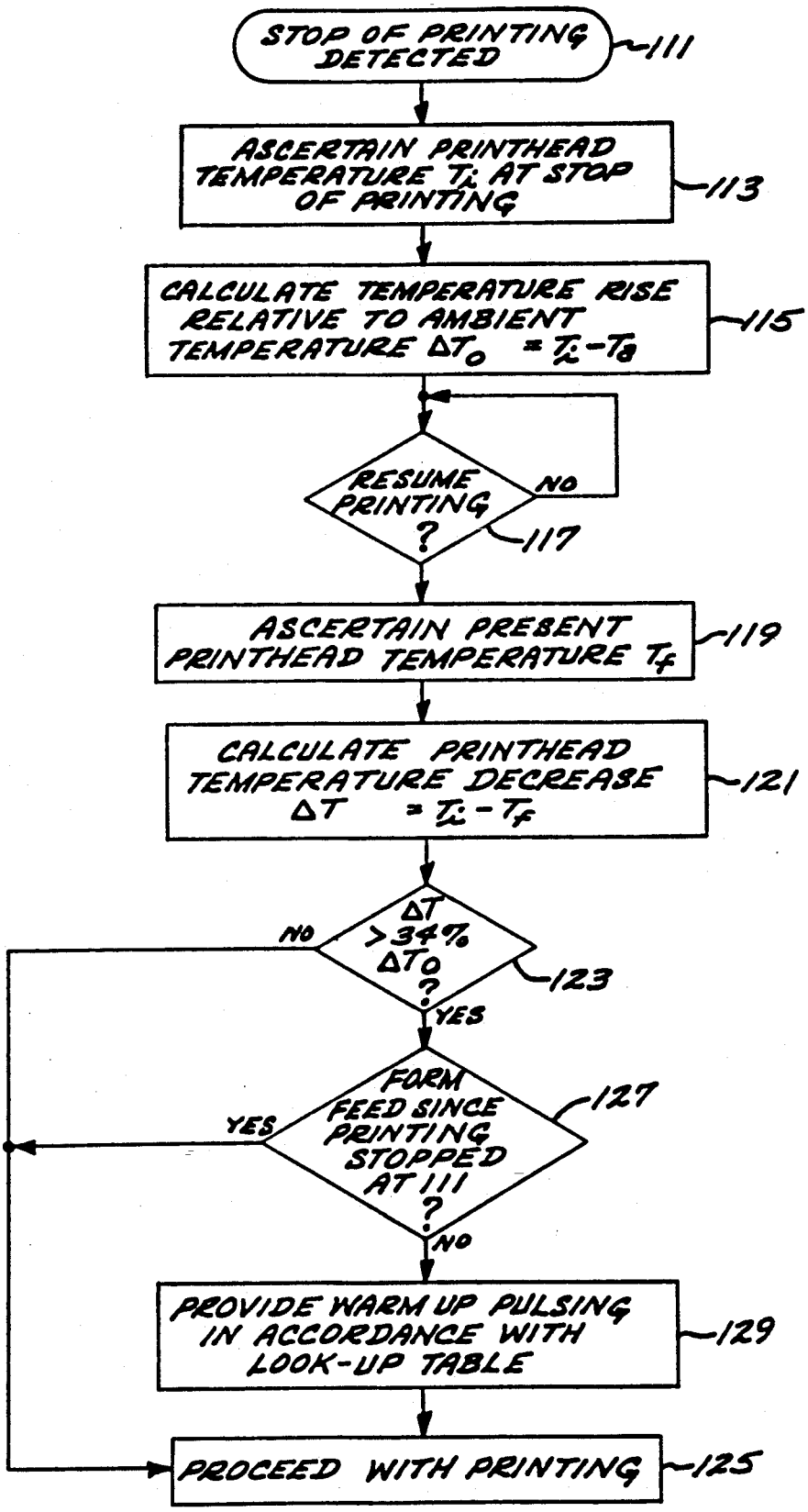
FIG. 5 is a flow diagram that sets forth a procedure for calculating and applying printhead warm-up pulses with the printer of FIG. 4.

Turning now to FIG. 5, set forth therein is a printhead warming process that is implemented with the components of the printer of FIG. 4. The process of FIG. 5 is based on the ambient temperature having been determined at power up, for example. At II the stop of printing is detected, and at 113 the printhead temperature is sensed. The temperature rise $\Delta T_o$ is calculated from the sensed printhead temperature $T_i$ and the ambient temperature $T_o$.

At 117 a determination is made as to whether printing is to be resumed. If no, the determination is repeated. If the determination at 117 is yes, printing is to be resumed, the printhead temperature $T_f$ is sensed at 119. At 121 the decrease in printhead temperature $\Delta T$ is calculated from the printhead temperature $\Delta T$ sensed at 119 and the printhead temperature $T_i$ sensed at the stop of printing.

At 123 at determination is made as to whether the decrease in printhead temperature $\Delta T$ is greater than 34% of the printhead temperature increase $\Delta T_o$ relative to ambient temperature. If no, printing proceeds at 125.

If the determination at 123 is yes, the decrease in printhead temperature $\Delta T$ is greater than 34% of the printhead temperature increase $\Delta T_o$ relative to ambient temperature, a determination is made at 127 as to whether a form feed has occurred since printing stopped at 111. If yes, printing proceeds at 125.

If the determination at 127 is no, a form feed did not occur since printing stopped at 111, warm-up pulses are applied pursuant to 129 for a duration that depends on the amount of printhead temperature decrease $\Delta T$ calculated at 121. By way of illustrative example, such warm-up pulsing duration can be determined by an equation since the temperature rise pursuant to warm up pulsing is generally linear. For the Hewlett-Packard printhead and warm up pulsing parameters identified above relative to the look-up table for the implementation without a temperature sensor, the warm up pulsing interval would be:

$$t_p = 250\Delta T \text{ msec (where } \Delta T \text{ is in degrees centigrade)}$$

Alternatively, a look-up table having pulsing intervals for different ranges of $\Delta T$ could be utilized to determine the duration of warm up pulsing required.

The foregoing has been a disclosure of a thermal ink jet printer that compensates for printhead cool down that adversely affects print quality, and is advantageously implemented by modification of existing printhead pulsing circuitry and/or pulsing control firmware.

Although the foregoing has been a description and illustration of specific embodiments of the invention, various modifications and changes thereto can be made by persons skilled in the art without departing from the scope and spirit of the invention as defined by the following claims.

What is claimed is:

1. In a thermal ink jet printer having a thermal printhead that includes ink firing resistors, a method for preventing wait time banding upon resumption of printing after a stop of printing, the method comprising the steps of:

(a) determining whether an elapsed wait time since printing stopped has exceeded a predetermined time interval;

(b) if elapsed wait time has not exceeded the predetermined time interval, continuing with step (f)

(c) if elapsed wait time has exceeded the predetermined time interval, determining whether a form feed occurred since printing stopped;

(d) if a form feed has occurred since printing stopped, continuing with step (f);

(e) if elapsed wait time has exceeded the predetermined time interval and a form feed has not occurred since printing stopped, driving the ink firing resistors of the printhead with warming pulses having a width that is insufficient to cause ink drop firing for a warming time period that depends on an amount of time that has elapsed since printing stopped; and (f) proceeding with printing.

2. The method of claim 1 wherein the step of driving the ink firing resistors with warming pulses comprises the step of determining the warming time period by reference to a look up table.

3. The method of claim 1 wherein warm-up pulses have an equal amplitude as ink drop firing pulses and a frequency greater than that of the ink drop firing pulses.

4. The method of claim 3 wherein the pulse width of the warm-up pulses is less than one-half the pulse width necessary to achieve ink drop firing at the warming pulse frequency.

5. The method of claim 3 wherein the pulse width of the warm-up pulses is approximately one-fourth the pulse width necessary to achieve ink drop firing at the warming pulse frequency.

6. In a thermal ink jet printer having a thermal printhead that includes ink firing resistors, a method for preventing wait time banding upon resumption of printing after a stop of printing, the method comprising the steps of:

(a) sensing printhead temperature upon the stop of printing;

(b) determining whether printing is to be resumed;

(c) if printing is to be resumed, sensing a printhead temperature and determining whether the printhead temperature has decreased by at least a predetermined amount;

(d) if the printhead temperature has not decreased by the predetermined amount, continuing with step (h);

(e) if the printhead temperature has decreased by the predetermined amount, determining whether a form feed has occurred since printing stopped;

(f) if a form feed has occurred since printing stopped, continuing with step (h);

(g) if a form feed has not occurred since printing stopped, driving the ink firing resistors of the printhead with warming pulses having a width that is insufficient to cause ink drop firing for a warming time period that depends on the amount of decrease of the printhead temperature that occurred between the stop of printing and detection that printing is to be resumed; and (h) proceeding with printing.

7. The method of claim 6 wherein the step of driving the ink firing resistors with warming pulses comprises the step of determining the warming time period by reference to a look up table.

8. The method of claim 6 wherein warm-up pulses have an equal amplitude as ink droop firing pulses and a frequency greater than that of the ink drop firing pulses.

9. The method of claim 8 wherein the pulse width of the warm-up pulses is less than one-half the pulse width necessary to achieve ink drop firing at the warming pulse frequency.

10. The method of claim 8 wherein the pulse width of the warm-up pulses is approximately one-fourth the pulse width necessary to achieve ink drop firing at the warming pulse frequency.

* * * * *